United States Patent [19]

Patel et al.

[11] Patent Number: 5,019,795

[45] Date of Patent: May 28, 1991

[54] SPLICE BLOCK FOR SECURITY SYSTEM SWITCH

[75] Inventors: Arvind Patel, Naperville; William Lenz, Crestwood; Jack J. Schafer, LaGrange, all of Ill.

[73] Assignee: Molex Incorporated, Lisle, Ill.

[21] Appl. No.: 446,746

[22] Filed: Dec. 6, 1989

[51] Int. Cl.[5] ..... H01H 45/04; H01K 4/24

[52] U.S. Cl. ..... 335/205; 439/404

[58] Field of Search ..... 335/151, 154, 205, 206, 335/207; 439/417, 620, 621, 622, 404

[56] References Cited

U.S. PATENT DOCUMENTS 4,695,113 9/1987 Eckhaus ..... 439/404

*Primary Examiner*—Harold Broome

*Attorney, Agent, or Firm*—Louis A. Hecht; Stephen Z. Weiss; A. A. Tirva

[57] ABSTRACT

A splice block for use with a condition responsive security switch is provided. The splice block is generally cylindrical and mounted to the end of the switch with terminals unitarily extending therebetween. The splice block includes a base and a cover which is mountable in alternate first and second positions on the base. The first position permits wires to be inserted into the splice block. Movement of the cover into the second position terminates the wires to terminals in the splice block.

28 Claims, 4 Drawing Sheets

SPLICE BLOCK FOR SECURITY SYSTEM SWITCH

BACKGROUND OF THE INVENTION

Security systems have received considerable commercial acceptance for virtually all types of residential, commercial and industrial buildings. Most such security systems are operative to detect an attempted intrusion and to generate a signal that will warn the occupants, summon security personnel and/or deter the intruder.

The security system typically will include intrusion detection means disposed at least at windows and exterior doors. One extremely effective and commercially accepted security system includes at least one and preferably a plurality of series circuits extending from access locations to a control unit. Each such series circuit will define a zone capable of generating a unique signal that can be detected by the control unit. The access points in each zone will be provided with condition responsive switches, reed switches or pressure sensitive switches. The two leads extending from the opposed portions of the switch will be incorporated into the series circuit. Thus, in the closed position of all switches, the series circuit will be completed. However, upon the opening of any switch, the series circuit will be opened. The control unit is operative to sense such an opening and will generate a signal to indicate a breach of the security for the zone in which the opened circuit exists.

The reed switches incorporated into these security systems include the combination of a switch having a magnetically responsive member therein plus a magnetic actuator movably disposed in proximity to the switch. The reed switch and the magnetic actuator are mounted to a door or window such that in the closed condition of the door or window the reed switch and the magnetic actuator are adjacent to one another. In this orientation, the magnet will be operative to keep the magnetically responsive portion of the reed switch in a condition for closing the circuit. However, a movement of the magnetic actuator corresponding to an opening of the window or the door will urge the magnetically responsive member of the reed switch into an open orientation which will be sensed by the control means for generating an appropriate signal.

Pressure sensitive switches employ the same principles as the above described reed switches. However, the typical pressure sensitive switch will include a movable plunger that is biased in a first direction for opening the switch but that is urged into an opposed direction by a movable portion of the door or window for closing the switch. Thus, in the closed condition of a door or window, the switch will be closed and the circuit into which the switch is incorporated will be complete. However, upon opening of the door or window, the plunger of the pressure sensitive switch will be moved in a direction for opening the switch and the associated series circuit. As explained above, the control unit of the security system will sense the open circuit and general an appropriate signal.

Other switches incorporating the same principles of selectively opened or closed circuits may also be incorporated into such a security system, and will be readily apparent to a person having ordinary skill in this art.

Residential property owners and owners of retail stores and other commercial establishments have tempered their desire for security with a desire for aesthetic attractiveness of their building. As a result, visually obtrusive security systems are considered substantially less desirable than security systems that can be substantially hidden from view. As a result, extremely desirable and effective security systems include those that can be completely hidden in the jamb of a door or the sill of a window. The ability to hide the switches of a security system is particularly difficult for security systems that are incorporated into buildings after the construction of the building is complete. Under these circumstances, and in view of the desire to hide the operative components of a security system, most such security systems are installed by drilling holes through a window sill or door jamb to an accessible location in a building, and typically an unfinished cellar or attic. The entry to these drilled holes adjacent the window or door necessarily will be substantially cylindrical. The installer of the security system will then snake a wire through the hole. The ends of the wire will then be stripped and the conductors therein will be manually spliced to conductive leads extending from the reed switch, pressure actuated switch or other such condition responsive switch. The switches will be of generally cylindrical configuration corresponding to the dimensions of the hole drilled in the sill of the window or jamb of the door. The installer will then urge the wire and the leads from the switch back through the hole and slidably insert the generally cylindrical switch into the previously drilled hole. With reed switches, it may then be necessary to mount an appropriate magnetic actuator in opposed relationship to the reed switch. Switches of this type have received substantial commercial acceptance in view of the ability to substantially hide the switch and wiring from view, and in particular the ability to readily mount the generally cylindrical switch in the correspondingly dimensioned cylindrical aperture drilled in proximity to the door or window. Any extremely effective switch of this general type is sold by Sentrol.

Despite the desirability of the above described switches and security systems, the installation of such systems is considered to be undesirably labor intensive. For example, the stripping of insulation from the wires and the splicing of wire leads adds significantly to the installation time of such systems and therefore increases the costs of such systems. Additionally, the spliced connections of the wire leads from the switch to the system wire often is fairly large as compared to the cross-sectional dimension of the hole drilled in the window sill or door jamb and relative to the switch slidably inserted therein. As a result, the spliced connections must be forcibly urged through the drilled holes. This forced movement of the splice connection into the relatively small drilled hole can at least partly disconnect the spliced connection. Thus, it may be necessary for the installer to repeat the labor intensive task of snaking the wire back through the walls of an existing building. Alternatively, the partially disconnected splice can generate periodic false alarms after the system has been completely installed.

The prior art includes electrical connectors for security systems that are intended to minimize labor intensive in-field splicing. For example, U.S. Pat. No. 4,695,113 issued to Eckhaus on Sept. 22, 1987 and shows electrical connectors for security systems which includes splicing means incorporated therein. However, the connectors disclosed in U.S. Pat. No. 4,695,113 are generally for visually obtrusive systems that are being commercially disfavored. In particular, the connectors shown in U.S. Pat. No. 4,695,113 require plural complex moving parts that are large and externally located relative to a door or window. The teaching of U.S. Pat. No. 4,695,113 is not helpful for the smaller visually unobtrusive systems that desirably are mounted in small cylindrical apertures hidden in the sill of a window or jamb of a door.

The prior art includes many other splice blocks having either a plurality of separate members that are movably disposed relative to one another to enable termination of conductive leads to terminals mounted in the splice block. The movable components of such splice blocks may be entirely separable structures or may be hingedly connected structures. These prior art splice blocks tend to be too large and unsuited for the particular needs of the security system industry. Furthermore, hinged connections on prior art splice blocks tend to be fairly large, cumbersome and ineffective for security system applications. Examples of such prior art splice blocks are shown in U.S. Pat. No. 4,284,316 which issued to Debaigt on Aug. 18, 1981, U.S. Pat. No. 4,749,366 which issued to McCaffery on June 7, 1988 and U.S. Pat. No. 4,441,778 which issued to Sampson on Apr. 10, 1984.

In view of the above, it is an object of the subject invention to provide an efficient splice block for security system applications.

It is another object of the subject invention to provide a combination cylindrical condition responsive switch and splice block.

It is an additional object of the subject invention to provide a generally cylindrical splice block that can be securely connectable to a generally cylindrical condition responsive sWitch.

A further object of the subject invention is to provide a unitarily molded splice block that can be slidably inserted into a drilled aperture.

Yet another object of the subject invention is to provide a generally cylindrical splice block having hingedly connected movable components wherein the hinge does not interfere with the insertion of the splice block into a drilled aperture.

SUMMARY OF THE INVENTION

The subject invention is directed to a splice block for a condition responsive security system switch, and to the combination of such a switch with a splice block. The splice block preferably is configured to lie within a generally cylindrical profile for a generally cylindrical condition responsive security system switch to enable slidable insertion of the splice block and the switch into a drilled aperture. The splice block may include a generally semi-cylindrical base and a generally semi-cylindrical cover selectively engageable with the base. The cover and the base may be hingedly connected to one another with the hinge being unitarily molded with both the base and the cover. Additionally, the base and the cover may be hingedly connected to one another at respective longitudinal ends thereof, such that the hinged connection does not interfere with the generally cylindrical profile of the splice block, and therefore does not impede the ability of the splice block to be slidably inserted into a generally cylindrical drilled aperture in the frame of a door or window.

The generally cylindrical splice block includes opposed longitudinal ends, including a forward end for mating to the condition responsive switch of the security system and a rearward end for receiving separate insulated conductors which define part of a series circuit for a security system. The forward end of the splice block may include a generally circular front wall dimensioned and configured for mating to the condition responsive switch of the security system. The front wall may include a forwardly directed mounting wall for engaging corresponding structure on the rearward end of the condition responsive switch. The forward wall of the splice block may further include a pair of apertures through which conductive circuit members of the switch extend, as explained further herein. The rearward end of the splice block may include aperture means extending therein for receiving the insulated conductors of the security system series circuit. Portions of the splice block intermediate the opposed longitudinal ends thereof may define a pair of generally longitudinally extending channels for receiving portions of the electrically conductive terminals. The channels may extend from the forward end to the rearward end of the splice block and connect opposed apertures in the forward and rear walls. The base of the splice block may further include locking means for lockingly engaging the cover in alternate first and second positions.

The cover of the splice block may include splice actuator means for effecting the termination of wires urged into the splice block. The actuator means may include appropriate structure for urging insulted wire leads into insulation displacement structure of a terminal disposed in the splice block. The actuator means is disposed to permit insertion of a wire into the splice block in the first relative position of the cover and base, and to terminate the wire upon movement of the cover into the second position relative to the base. To facilitate the movement of the cover into the second position relative to the base, the cover and/or the base may be provided with appropriately configured non-cylindrical portions for engagement with pliers or other application tooling. For example, the cover and the base may be provided with opposed generally parallel flats interrupting an otherwise generally cylindrical outer profile.

The splice block and condition responsive security system switch of the subject invention further comprises a pair of terminals. In particular, the terminals may include wire engaging portions and switch engaging portions. The wire engaging portions may be mountable in the splice block, with the switch engaging portions extending forwardly from the splice block and into the condition responsive switch. The wire engaging portions of the terminals may be dimensioned to be securely received in the channels of the base of the splice block. For example, the wire engaging portions may include insulation displacement structure formed unitarily therein for displacing insulation on a wire and achieving secure electrical contact with the conductors of the wire. The wire engaging portion of each terminal may be disposed to enable the longitudinal adVancement of a wire into the splice block when the cover and the base of the splice block are in their first relative position. The movement of the cover and the base of the splice block into the second relative position will cause a corresponding lateral movement of the wire and/or the terminal to effect electrical contact therebetween as explained in detail below.

Portions of each terminal extending forwardly from the splice block may be disposed and dimensioned to be mounted in the condition responsive switch. For example, the terminals may include switch contact portions for engaging opposed ends of a reed for security systems relying upon reed switches. In this regard, the reed or magnetically activated portion of the reed switch may extend generally along the longitudinal axis of the cylindrical housing for the reed switch. The switch contact of one terminal may extend longitudinally generally parallel to the reed, and may further include a laterally extending contact portion at the extreme forward end of the reed switch. The opposed terminal may be significantly shorter and may include contact structure for engaging the rearward end of the reed in the reed switch.

The forward end of the splice block and the rearward end of the condition responsive switch housing may be securely affixed to one another by mechanical mating, appropriate adhesives or sonic welding. In particular, the generally circular forward wall of the splice block may be engaged with a correspondingly configured circular rear wall of the condition responsive switch, with the terminals and other circuitry extending therebetween. The cover may then be rotated about the hinged connection and engaged on the base of the splice block in the first relative position. The assembly of the condition responsive switch and splice block may be sold to security system installers in this rigidly connected condition. The installer then merely has to insert the longitudinal ends of the insulated wires into the rear end of the splice block. Upon complete insertion of both wires, the cover is merely advanced into the second position relative to the base. This movement of the cover from the first position to the second position will terminate the wires into the terminals previously mounted in the base of the splice block. Movement of the cover from the first position to the second position can be achieved by appropriate application tooling which may engage non-cylindrical exterior surfaces on the cover and/or base of the splice block.

DETAILED DESCRIPTION OF THE PREFERRED EMBODIMENT

Figure 1:
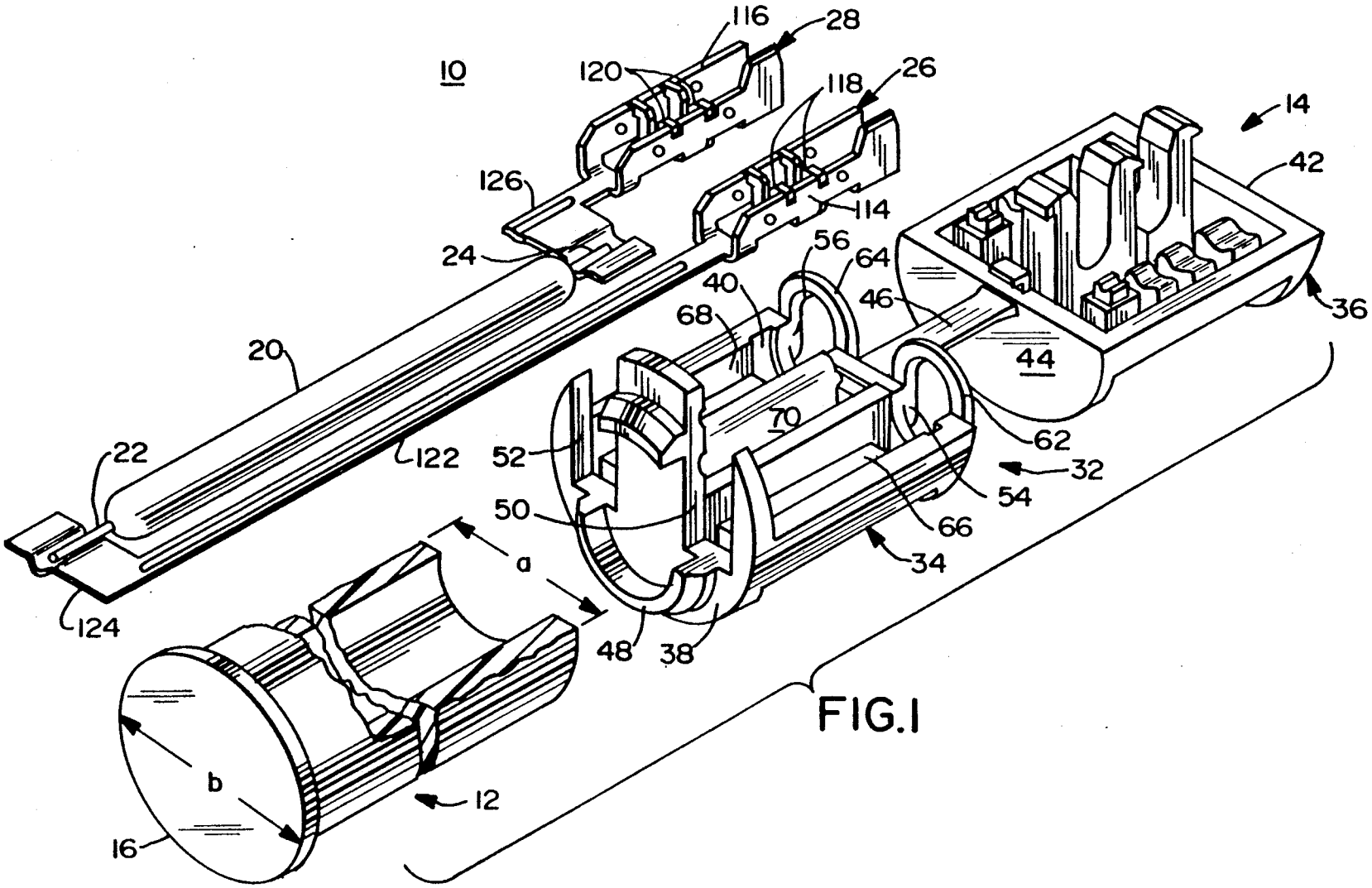
FIG. 1 is an exploded perspective view of a splice block and condition responsive switch in accordance with the subject invention.
Figure 2:
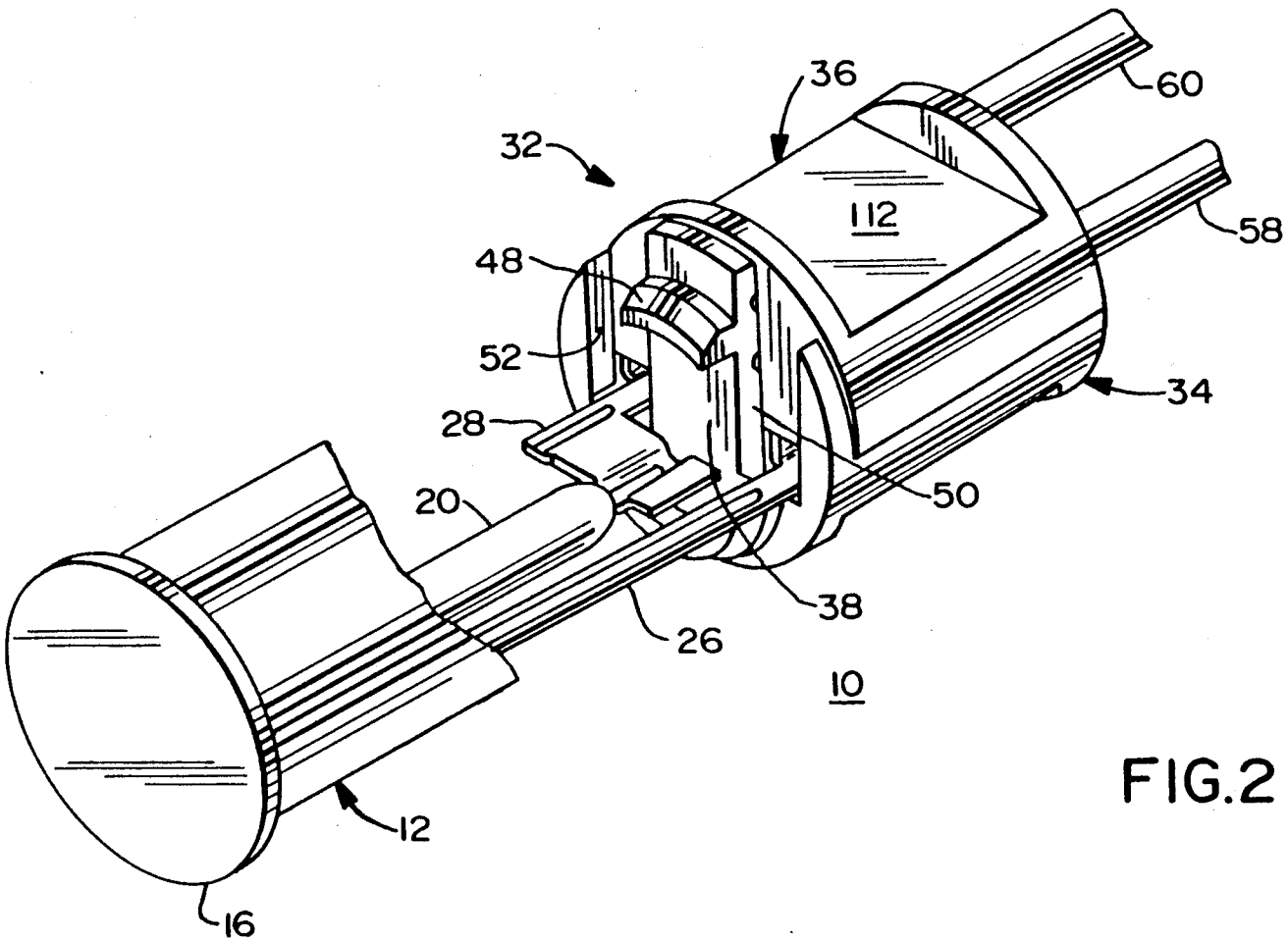
FIG. 2 is a perspective view, partly in section, of the assembled splice block and switch.

A splice block and condition responsive switch in accordance with the subject invention is identified generally by the numeral 10 in FIGS. 1 and 2. The assembly 10 comprises a condition responsive switch 12 to which a splice block 14 is connected. The assembly 10 is specifically intended for use in the circuitry of a security system which is intended to detect an attempted intrusion into a building through a window, door or the like. More particularly, the condition responsive switch and splice block assembly 10 is intended to be mounted in a drilled cylindrical aperture in the frame of a window or door, such as in the portion of a door jamb to which the hinges are affixed or the portion of a window sill against which the window closes.

The condition responsive switch 12 depicted in FIGS. 1 and 2 is a reed switch having a hollow open-ended cylindrical housing 16 of unitary molded construction and a magnetically responsive reed element 20 disposed therein. The reed element 20 has opposed first and second conductive leads 22 and 24 extending therefrom and being electrically connected to first and second terminals 26 and 28. The terminals 26 and 28 extend between the condition responsive switch 12 and the splice block 14 and are described in greater detail below. As shown most clearly in FIG. 2, the reed element 20 and portions of the terminals 26 and 28 are potted or otherwise secured in the cylindrical housing 16. The cylindrical housing 16 defines a diameter "a" which is slightly less than the nominal diameter of the drilled hole into which the assembly 10 will be inserted. For example, the diameter "a" may be approximately 0.250 inch to permit the relatively easy insertion of the switch 12 into a hole drilled by a three-eighth inch drill bit. However, the cylindrical housing 16 may include a head 28 respectively defining a diameter "b" which is greater than the diameter "a". The diameter "b" may be approximately equal to or slightly greater than the diameter of the hole drilled into the window or door frame to prevent the switch 12 from passing too far into the hole.

It should be noted that the condition responsive switch 12 illustrated herein may be replaced by a functionally equivalent pressure sensitive switch as opposed to a reed switch. It also should be noted that reed switches similar to those shown herein are known, and particularly good reed switches for these purposes are sold by Sentrol. However, as noted above, the prior art reed switches of this general type included a pair of insulated leads extending therefrom which had to be manually stripped and spliced to other leads by a security system installer in the field.

The splice block 14 includes a housing 32 which is unitarily molded from a non-conductive material. The housing 32 includes a generally semi-cylindrical base 34 and a generally semi-cylindrical cover 36. The base 34 includes a generally circular forward wall 38 and a generally semi-circular rear wall 40 defining the opposed longitudinal ends of the base 34. Similarly, the cover 36 includes a forward generally semi-circular wall 42 and a rear generally semi-circular wall 44. The cover 36 is hingedly articulated to the base 34 by a hinge 46 which extends unitarily between and connects the rear walls 40 and 44 of the base 34 and cover 36 respectively. The hinge 46 may include frangible connections to the base 34 and cover 36 to enable selective removal of the hinge 46 from the remainder of the housing 32 after the cover 36 has been mounted to the base 34 in a first position thereon. This option will be explained in greater detail below.

The front wall 38 of the base 34 includes a forwardly projecting generally annular mounting wall 48 extending therefrom. The generally annular mounting wall 48 is dimensioned and configured to mate in the rearwardly disposed open end of the housing 16 of the condition responsive switch 12. As illustrated in FIGS. 1 and 2, the forwardly projecting mounting wall 48 is configured to properly align with the open end on the switch 12 without locking interengagement therebetween. Rather, the fixed connection of the switch 12 and the splice block 14 is achieved by sonic welding, adhesive or other known means. However, in certain embodiments a mechanical locking between the condition responsive switch 12 and the splice block 14 may be provided.

The front wall 38 on the base 34 of the splice block 14 further includes a pair of notches 50 and 52 respectively. The notches 50 and 52 are disposed and dimensioned to receive portions of the first and second terminals 26 and 28 respectively which extend between the splice block 14 and the switch 12.

The rear wall 40 on the base 34 of the splice block housing 32 is characterized by first and second apertures 54 and 56 respectively. The apertures 54 and 56 are dimensioned to receive insulated conductors 58 and 60 as illustrated in FIG. 2. The rear wall 40 is further characterized by wire guides 62 and 64 respectively which bridge the apertures 54 and 56 for insuring proper insertion of the wires 58 and 60 into the splice block 14 in the first position of the cover 36 on the base 34 thereof.

The base 34 is further characterized by first and second terminal receiving channels 66 and 68 which extend longitudinally between the opposed front and rear walls 38 and 40 of the base 34. More particularly, the first channel 66 is aligned with and extends between the first aperture 50 in the front wall 38 and the first aperture 54 in the rear wall 40. Similarly, the second channel 68 is aligned with and extends between the second aperture 52 in the front wall 38 and the second aperture 56 in the rear wall 40. The first and second channels 66 and 68 are dimensioned to receive the first and second terminals 26 and 28 respectively as explained further herein.

Figure 3:
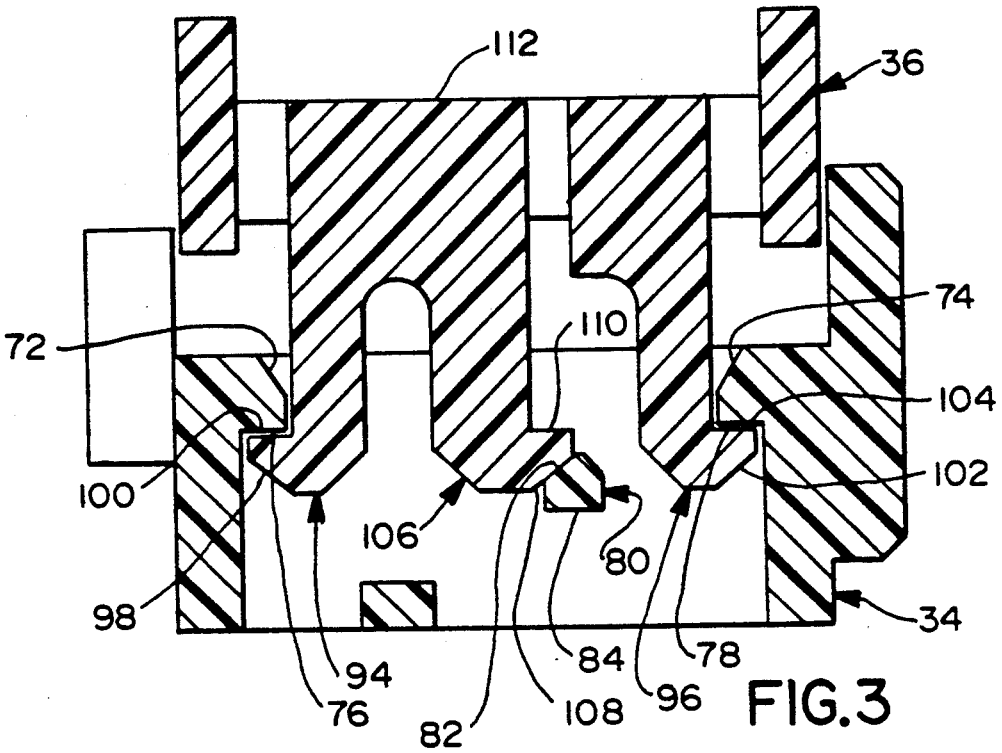
FIG. 3 is a longitudinal cross section of the splice block showing the cover and base thereof in a first relative position.
Figure 4:
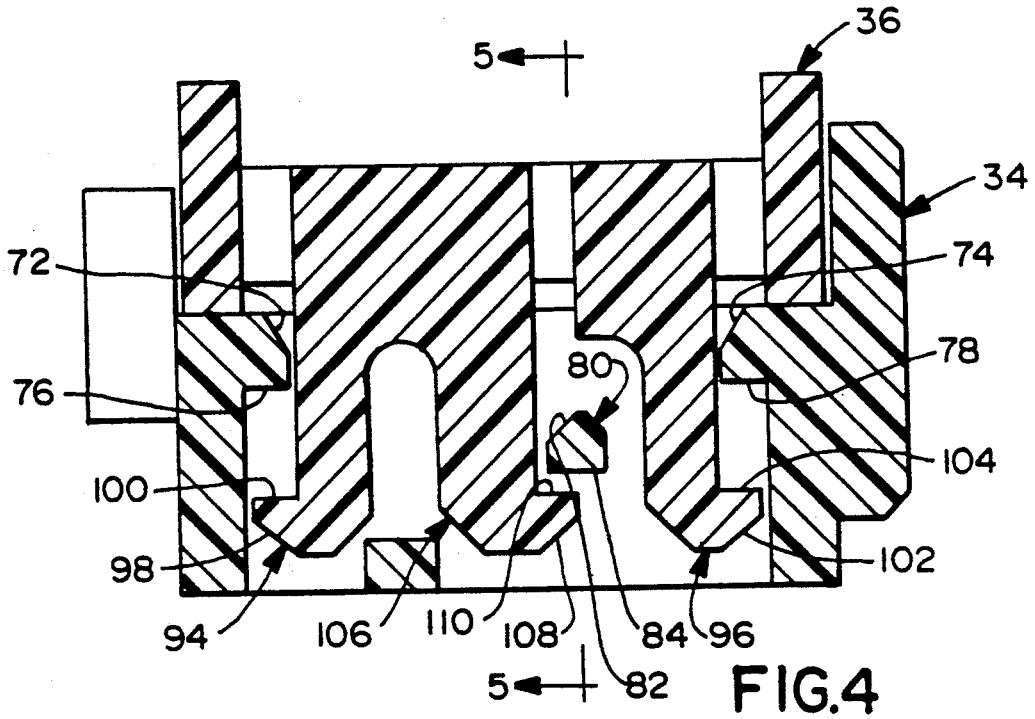
FIG. 4 is a cross-sectional view similar to FIG. 3 but showing the cover and base of the splice block in a second relative position.

As shown most clearly in FIG. 1, the base 34 further includes a central locking channel 70 which extends generally longitudinally between the front and rear walls 38 and 40. Portions of the front and rear wall 38 and 40 extending into the locking channel 70 define front and rear ramped surfaces 72 and 74, as shown in FIGS. 3 and 4. Portions of the respective front and rear walls 38 and 40 disposed deeper in the locking channel 70 define front and rear locking surfaces 76 and 78 respectively. The front and rear first locking surfaces 76 and 78 are aligned generally parallel to the longitudinal axis of the base 34 and are facing generally toward the bottom of the base 34. The locking channel 70 further includes a locking wall 80 extending thereacross. The locking wall 80 is characterized by an upwardly facing ramped surface 82 and by a locking surface 84 which is disposed deeper in the channel 70 than the front and rear locking surfaces 76 and 78.

The cover 36 of the splice block housing 32 is dimensioned to mate with the base 34 intermediate the front and rear walls 38 and 40 of the base 34. The cover 36 is characterized by first and second actuators 90 and 92 disposed to be aligned with and extend into the channels 66 and 68 of the base 34.

The cover 36 further includes deflectable front and rear locking latches 94 and 96 respectively. The front locking latch 94 includes a leading ramp surface 98 for ramped engagement with the surface 72 of the front wall 38 of the base 34 to facilitate deflection of the front latch 94. The front latch 94 further includes a locking surface 100 disposed to be engaged by the front locking surface 76 of the base 34. Similarly, the rear latch 96 includes a ramping surface 102 which is disposed to engage the rear ramp surface 74 of the rear wall 40 on the base 34 to facilitate deflection of the rear latch 96. The rear latch 96 further includes a rear locking surface 104 for lockingly engaging the rear locking surface 78 of the base 34. As shown most clearly in FIG. 3, the front locking surfaces 76 and 100 and the rear locking surfaces 78 and 104 are in locking engagement with one another when the cover 36 is in the first relative position on the base 34. As will be explained further below, the first position of the cover 36 on the base 34 permits the insertion of the wires 58 and 60 into the splice block 14.

The cover 36 further includes a deflectable latch 106 which is disposed intermediate the front and rear latches 94 and 96. The latch 106 includes a ramped surface 108 which is disposed to engage the ramped surface 82 of the locking wall 80 in the base 34 to function as a detent which will prevent the cover 36 from advancing unintentionally and prematurely into the second locked condition on the base 34. The deflectable latch 106 further includes a locking surface 110 to engage the locking surface 84 of the base 34 to lockingly retain the cover 36 on the base 34 in the second relative position thereof. More particularly, when the cover 36 is in the second position on the base 34, as shown in FIG. 4, the wires 58 and 60 will have been terminated within the splice block 14.

As shown in FIGS. 2–4, the cover 36 is further characterized by a flat 112 which cooperates with the base 34 to receive application tooling for terminating the wires 58 and 60.

Figure 5:
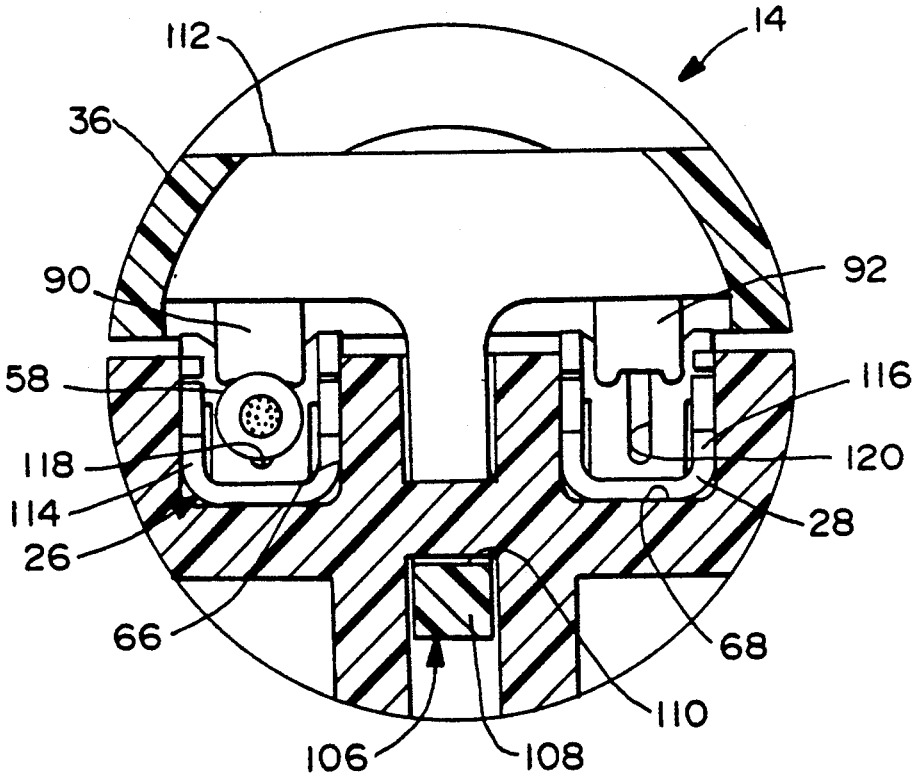
FIG. 5 is a cross-sectional view taken along line 5—5 of FIG. 4.

The first and second terminals 26 and 28 include wire engaging barrels 114 and 116 respectively which are receivable in the respective channels 66 and 68 of the base 34. The barrels 114 and 116 each include insulation displacement slots 118 and 120 respectively which are unitarily formed with the terminals 26 and 28 and which are configured to slice through, pierce or otherwise displace the insulation on the wires 58 and 60 and achieve electrical contact with the conductors therein. The preferred ID slot 118 is shown most clearly in FIG. 5. However, it is to be understood that other configurations of an insulation displacement structure may also be provided.

The first terminal 26 includes an elongated longitudinally extending terminal arm 122 which is dimensioned to pass through the first opening 50 in the front wall 38 of the base 34 and into the housing of the condition responsive switch 12. The elongated terminal arm 122 has a laterally extending contact 124 at its extreme forward end. The contact 124 is dimensioned to engage the lead 22 of the reed element 20 generally adjacent the forward end of the reed switch 12.

The second terminal 28 includes a forwardly extending terminal arm 126 which is substantially shorter than the arm 122. The terminal arm 126 includes a laterally extending contact for contacting the conductive lead 24 extending from the opposed end of the reed element 20.

The reed element 20 and the terminal arm portions 122 and 126 of the first and second terminals 26 and 28 respectively may be soldered together and slidably inserted into the open end of the housing 16, and may be potted or otherwise secured therein with an epoxy or other such initially flowable material. The base 34 of the spliced block 14 may then be mounted to the switch 12. More particularly, the front wall 38 is engaged against the housing of the switch 12 such that the first and second terminals 26 and 28 pass through the first and second apertures 50 and 52 in the front wall 38. In this aligned relationship, the barrels 114 and 116 of the first and second terminals 26 and 28 respectively will be positioned in the first and second channels 66 and 68.

The front wall 38 of the base 34 preferably then is permanently affixed to the rear of the housing 16 of the switch 12 by appropriate application of adhesive or by sonic welding. The cover 36 then is rotated about the hinge 46 such that the front and rear first latches 94 and 96 enter the locking channel 70 of the base 34. More particularly, the cover 36 is advanced sufficiently to cause the respective front and rear ramping surfaces 98 and 102 to engage the opposed ramping surfaces 72 and 74 on the base 34. This engagement of the opposed ramping surfaces will cause a deflection of the front and rear latches 94 and 96 as the cover 36 is advanced over the base 34. Sufficient advancement of the cover 36 toward the base 34 will cause the latches 94 and 96 to deflect, with the front and rear locking surfaces 100 and 104 of the cover 36 lockingly engaging the front and rear locking surfaces 76 and 78 of the base 34 to retain the cover 36 in the first position on the base 34 as shown in FIG. 3. Once the cover 36 has been locked to the base 34 in the first position, the hinge 46 can be removed if desired.

The switch 12 and the splice block 14 with the cover 36 engaged in the first position on the base 34 may be sold to security system installers. The security system installer need merely insert insulated wire leads 58 and 60 into the first and second apertures 54 and 56 in the rear wall 40 of the base 34. The installer may then use application tooling, pliers or the like to advance the cover 36 into the second position relative to the base 34. More particularly, the forces exerted on the flat 112 of the cover 36 and on the base 34 will cause the latch 106 to initially deflect against the locking wall 80 of the base 34. Sufficient advancement of the cover 36 over the base 34 will cause the latch 102 to resiliently return to its undeflected condition with the locking surface 110 thereof engaging the locking surface 84 of the base 34. As the cover 36 advances into the second position on the base 34, the actuators 94 and 96 of the cover 36 will urge the first and second wires 58 and 60 through the insulation displacement slots 118 and 120 of the respective first and second terminals 26 and 28 to terminate the wires 58 and 60 in the splice block 14. It will be appreciated that this termination completely avoids the stripping and splicing that had been employed in the prior art. The terminated switch 12 and splice block 14 may then be slidably inserted into a drilled aperture in a window or door frame. The termination of the wires 58 and 60 are protected from damage during the insertion of the switch 12 and splice block 14 into the aperture.

In summary, a splice block is provided for use with a condition responsive switch of a security system. The splice block and the switch are of generally cylindrical configuration for slidable insertion into a drilled aperture in a window or door frame. The splice block is connected to one longitudinal end of the switch with terminals extending unitarily therebetween. The splice block includes a generally semi-cylindrical cover that is lockingly engageable in alternate first and second positions on a base of the splice block. Wire leads can be inserted into the splice block when the cover is in a first position relative to the base. Movement of the cover into the second position relative to the base terminates the wires in the splice block to complete the electrical connections to the condition responsive switch. The terminated wires along with the splice block and switch can then be slidably inserted into a cylindrical drilled aperture in a window or door frame.

While the invention has been described with respect to a preferred embodiment, it is apparent that various changes can be made without departing from the scope of the invention as defined by the appended claims. For example, the center latch may lock the cover in the first position on the base of the housing, while the front end and rear latches may lock the cover in the second position to ensure secure retention and proper alignment of the cover on the base in the second position.

We claim:

1. In a condition responsive security system switch including a generally cylindrical switch housing having a generally circular rear end and condition responsive switch means therein for alternately completing and breaking a circuit in response to a selected condition, said switch further including terminals electrically connected to said condition responsive switch means and extending from the rear end of the switch housing, wherein the improvement comprises a splice block comprising:

a generally cylindrical splice block housing having a front wall substantially conforming to the configuration of the rear end of the switch housing and engageable therewith, the front wall of the splice block housing including at least one aperture extending therethrough for receiving portions of the terminals extending from the rear end of the switch housing, terminal receiving means disposed in said housing for securely positioning portions of terminals therein, a rear wall having wire receiving apertures extending therethrough generally in line with the terminal receiving means; and an actuator selectively engageable in alternate first and second positions relative to the splice block housing, whereby the engagement of the actuator in the first position enables insertion of wires into the wire receiving apertures and generally into alignment with portions of the terminals disposed in the terminal receiving means, and wherein engagement of the actuator in the second position electrically connects the terminals to the wires.

2. A splice block as in claim 1 wherein the front wall of the splice block housing comprises means for aligning said splice block to said switch housing.

3. A splice block as in claim 1 wherein the front wall of the splice block housing comprises a pair of apertures dimensioned and aligned respectively to receive portions of the terminals extending into the splice block housing.

4. A splice block as in claim wherein the actuator comprises at least first and second resiliently deflectable latches alternately lockingly engageable in the first and second positions relative to the splice block housing.

5. A splice block as in claim 4 further comprising at least first and second looking surfaces disposed generally centrally between the terminal receiving means of the splice block housing for selectively engaging the respective first and second latches of the actuator.

6. A splice block as in claim 1 wherein portions of the terminals received in the splice block housing comprise insulation displacement means thereon for displacing selected portions of insulation on the wires, and wherein the actuator comprises means for urging the wires into the insulation displacement means of the terminals.

7. A splice block as in claim 1 wherein the actuator is hingedly connected to the splice block housing.

8. A splice block as in claim 7 wherein the actuator is hingedly connected to the rear wall of the splice block housing.

9. A splice block as in claim 7 further comprising hinge means for hingedly connecting the actuator to the rear wall of the splice block housing.

10. A splice block as in claim 9 wherein the hinge means is selectively separable from the splice block housing.

11. A condition responsive security system switch having a generally cylindrical switch housing with a generally circular rear end, condition responsive switch means mounted in the switch housing, first and second terminals connected to said condition responsive switch means and extending from the rear end of the switch housing, said first and second terminals comprising wire engaging portions at locations thereon external of the switch housing, wherein the improvement comprises:

a splice block of generally cylindrical configuration and having a splice block housing with a generally semi-cylindrical base, a generally circular front wall extending from the base and being engageable with the rear wall of the switch housing, said front wall including aperture means extending therethrough for receiving portions of the first and second terminals respectively, first and second terminal receiving channels generally in line with the aperture means in the front wall of the splice block housing for receiving the wire engaging portions of the first and second terminals respectively, a rear wall having wire receiving means extending therethrough and generally in line with the first and second terminal receiving channels respectively, a cover hingedly connected to the base and being rotatable into locking engagement with the base, said cover including first and second termination means disposed for alignment with the first and second terminal receiving channels when the cover is rotated into locking engagement with the base, said first and second termination means being configured to terminate first and second wires to the first and second terminals upon rotation of the cover into locking engagement with the base.

12. A switch as in claim 11 wherein the cover includes an externally disposed planar surface for facilitating urging the cover into the second position relative to the remainder of splice block.

13. A switch as in claim 11 wherein the cover is hingedly connected to the base at the rear wall of the base.

14. A switch as in claim 13 wherein the hinged connection is defined by a flexible hinge extending unitarily between the rear wall of the base and the cover.

15. A switch as in claim 14 wherein the hinge is selectively removable from the base and the cover.

16. A switch as in claim 11 wherein the front wall of the base includes alignment means for aligning the splice block to the rear end of the switch housing.

17. In a condition responsive security system switch having a switch housing with a rear end, a condition responsive switch means in said housing for selectively completing and breaking a circuit in response to a selected condition, and stamped and formed terminals connected to the condition responsive switch means and extending unitarily from the rear end of the switch housing, said improvement comprising:

a splice block base having a front wall generally conforming to the shape of the rear end of the switch housing and being mateable therewith, said front wall including aperture means extending therethrough for receiving portions of the terminals extending from the switch housing, terminal positioning means disposed in said base for securely positioning selected portions of the terminals therein, a rear wall in generally opposed relationship to the front wall of the base and having wire receiving means extending therethrough for receiving first and second wires generally in alignment with the portions of the first and second terminals disposed in the base; and a splice block cover unitarily connected to the base and hingedly rotatable into alternate first and second positions on the base, such that in the first position the cover permits insertion of the first and second wires into the wire receiving means in the rear wall of the base, and such that in the second position the cover urges the wires into engagement with the portions of the first and second terminals positioned in the base.

18. A splice block as in claim 17 wherein the switch housing is generally cylindrical, and wherein the cover and the base are configured to define a generally cylindrical splice block generally conforming to the cylindrical shape of the switch housing.

19. A splice block as in claim 18 wherein the cover includes a flat wall disposed thereon for facilitating the movement of the cover into the second position on the base.

20. A splice block as in claim 17 wherein portions of the first and second terminals disposed in the base include insulation displacement slots, and wherein the cover includes first and second actuators for urging the respective first and second wires into the insulation displacement slots.

21. A splice block as in claim 17 wherein the front wall of the splice block base includes forwardly projecting alignment means for aligning the base with the rear end of the switch housing.

22. A splice block as in claim 17 wherein the hinged connection of the cover to the base is defined by a flexible hinge extending unitarily from the rear wall of the base to the cover.

23. A splice block as in claim 22 wherein the flexible hinge is selectively removable from the cover and the base.

24. A splice block housing unitarily molded from a non-conductive material and comprising a base having means for mounting at least one electrically conductive terminal therein, an actuator hingedly connected to the base for limited movement relative thereto, said actuator and said base comprising means for selectively locking the actuator and the base in alternate first and second positions relative to one another, said means for selectively locking comprising a channel in said base defined by end and side walls and a floor, portions of the walls extending into the channel having ramp surfaces facing away from the floor and locking surfaces facing and parallel to the floor, said ramp and locking surfaces located at substantially the same height above the floor, a locking wall extending across the channel having a ramp surface facing away from the floor and a locking surface facing and parallel to the floor said surfaces located below said surfaces of the wall portions, first, second and third deflectable latches extending from the actuator, each having a ramp surface and a locking surface, wherein the ramp surfaces of the first and second latch are adapted to engage rap surfaces of the wall portions when the actuator is mated with the base and upon application of a predetermined force the first and second latches are deflected allowing the locking surfaces of the wall portions to engage the locking portions of the first and second latch and wherein the ramp surface of the third latch engages the ramp surface of the locking wall stopping the actuator form further movement thereby determining the first position, and wherein upon application of a second force of a predetermined magnitude the third latch is deflected allowing the locking surface of the wall surface to engage the locking surface of the third latch locking the actuator in the second position, said splice block housing further comprising at least first and second access means for permitting access of at least first and second conductors from a locations external to said housing to at least one location in proximity to the means for mounting the terminal, and termination means unitary with said actuator and disposed for terminating at least one said conductor to the terminal mounted in the housing.

25. A splice block housing as in claim 24 wherein the access means defines at least one aperture extending through a portion of the housing.

26. A splice block housing as in claim 24 further comprising a flexible hinge extending unitarily between the base and the actuator for defining the hinged connection therebetween.

27. A splice block housing as in claim 26 wherein the hinge is selectively removable from the base and the actuator.

28. In a housing for an electronic device, the housing having a rear end, stamped and formed terminals connected to the electronic device and extending unitarily from the rear end of the housing, said improvement comprising:

a splice block base having a front wall generally conforming to the shape of the rear end of the housing and being mateable therewith, said front wall including aperture means extending therethrough for receiving portions of the terminals extending from the housing, terminal positioning means disposed in said base for securely positioning selected portions of the terminals therein, a rear wall in generally opposed relationship to the front wall of the base and having wire receiving means extending therethrough for receiving first and second wires generally in alignment with the portions of the first and second terminals disposed in the base; and a splice block cover unitarily connected to the base and hingedly rotatable into alternate first and second positions on the base, such that in the first position the cover permits insertion of the first and second wires into the wire receiving means in the rear wall of the base, and such that in the second position the cover urges the wires into engagement with the portions of the first and second terminals positioned in the base.

* * * * *